US008632831B2

(12) United States Patent
Perry et al.

(10) Patent No.: US 8,632,831 B2
(45) Date of Patent: Jan. 21, 2014

(54) MICROWAVE BATTER PRODUCT

(75) Inventors: Michael R. Perry, Plymouth, MN (US); Joanne J. Garbe, Columbia Heights, MN (US); Peter S. Pesheck, Maple Grove, MN (US)

(73) Assignee: General Mills, Inc., Minneapolis, MN (US)

( * ) Notice: Subject to any disclaimer, the term of this patent is extended or adjusted under 35 U.S.C. 154(b) by 442 days.

(21) Appl. No.: 12/812,834

(22) PCT Filed: Jan. 14, 2008

(86) PCT No.: PCT/US2007/071112

§ 371 (c)(1),
(2), (4) Date: Jan. 20, 2011

(87) PCT Pub. No.: WO2009/154588

PCT Pub. Date: Dec. 23, 2009

(65) Prior Publication Data

US 2011/0123682 A1 May 26, 2011

(51) Int. Cl.
*A21D 10/02* (2006.01)

(52) U.S. Cl.
USPC ..... 426/107; 426/113; 426/128; 426/234; 426/407; 219/728; 219/729

(58) Field of Classification Search
USPC ..... 426/107, 113, 128, 234, 407; 219/728, 219/729
See application file for complete search history.

(56) References Cited

U.S. PATENT DOCUMENTS

| | | | | |
|---|---|---|---|---|
| 4,663,506 | A | 5/1987 | Bowen et al. | |
| 4,874,618 | A * | 10/1989 | Seaborne et al. | 426/76 |
| 5,079,012 | A | 1/1992 | Lengerich et al. | |
| 5,101,084 | A * | 3/1992 | Atwell et al. | 219/728 |
| 6,224,924 | B1 * | 5/2001 | Narayanaswamy et al. | 426/128 |
| 2003/0087015 | A1 * | 5/2003 | Wyslotsky et al. | 426/397 |
| 2006/0073243 | A1 | 4/2006 | Bows et al. | |
| 2006/0191934 | A1 | 8/2006 | Kreisman et al. | |

OTHER PUBLICATIONS

Liesl, M., Permeability Properties of Plastics and Elastomers, 2nd ed., Plastics Design Library, Norwich, NY, 2003 table 39-01.*
The Implusive Buy, Betty Crocker, Warm Delights, [on line] Dec. 8, 2005, retrieved Mar. 5, 2013. Retrieved from the Internet: URL:<http://www.theimpulsivebuy.com/wordpress/2005/12/08/betty-crocker-hot-fudge-brownie-warm-delights/>.*

* cited by examiner

*Primary Examiner* — Rena Dye
*Assistant Examiner* — Chaim Smith
(74) *Attorney, Agent, or Firm* — Everett G. Diederiks, Jr.; John L. Crimmins

(57) ABSTRACT

Shelf stable microwave dessert packaged food products for individual servings comprise a novel, shielded packaging or container including a microwave shielded cup; a shelf-stable ready-to-heat uncooked product disposed within the cup, a modified low oxygen atmosphere in the headspace above the batter, and a peelably removable, low gas permeability sealing membrane. The articles provide high preparation abuse tolerance notwithstanding the low, controlled portion quantities (100 calorie) of batter.

28 Claims, 1 Drawing Sheet

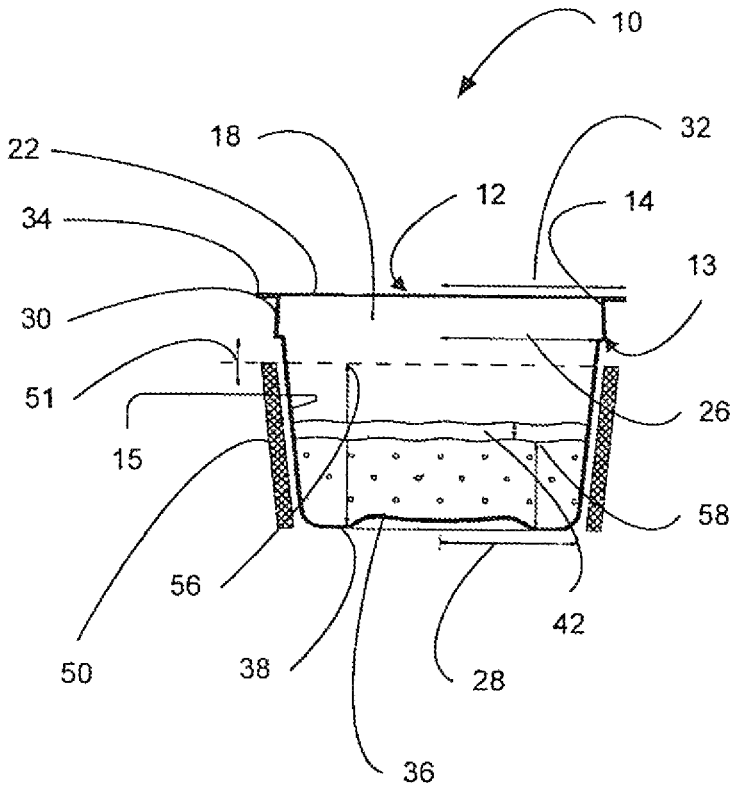
10
22
18
32
12
14
34
13
30
51
26
15
58
56
42
50
38
28
36

MICROWAVE BATTER PRODUCT

CROSS-REFERENCE TO RELATED APPLICATIONS

This application represents a National Stage application of PCT/US2007/071112 entitled "Microwave Batter Product" filed Jan. 14, 2008, pending.

FIELD OF THE INVENTION

The present invention relates to packaged food products, and to packaging for such products and to their methods of preparation. More particularly, the present invention relates to a shelf stable microwave dessert packaged food product for individual servings.

BACKGROUND OF THE INVENTION

The present invention is directed towards a packaged food article for the microwave cooking of an individual or small portion of an uncooked batter such as for a dessert, e.g., a cake, muffin or brownie. The present products are individual convenience snack or dessert items.

Of course, any number of dessert food items can be reheated in a microwave oven. For example, if desired, a previously baked slice of a fruit pie or a baked muffin or baked brownie piece can be warmed by reheating by microwave heating. Moreover, any number of packaged ready-to-cook consumer food products can be or are specifically adapted to reheating prior to consumption. For example, a number of sandwich or hotdog-and-bun products are packaged in flexible film packaging that are intended to be distributed under refrigeration temperatures and microwave heated immediately prior to consumption.

Recently, a convenience packaged food product has been introduced in the United States for the microwave cooking of an individually sized portion of a dessert under the Warm Delights trademark. The product is in the form of a kit comprising a dessert dry mix packet (75 g), a second pouch (18 g) of topping applied after cooking, a plastic bowl and microwave preparation instructions. The consumer is instructed to open the dry mix packet and pour the dry mix into the bowl. The consumer is then asked to admix a small quantity, e.g., 4 teaspoons (20 mL) of water to the dry mix to form a batter in the bowl. The product is then microwave heated for about 75 seconds and a topping is applied to the finished baked product to form a freshly made microwave heated dessert. (See, for example, U.S. Ser. No. 60/649,251 "Container To Facilitate Microwave Cooking And Handling" (filed Feb. 2, 2005 by Kreisman et al.). Even when such finished goods are prepared by microwave heating, such finished cooked goods are still colloquially referred to as "baked goods".

While useful, the present invention provides improvements over the Warm Delights™ dessert kit arrangement. In one respect, the present invention provides a shelf stable, ready-to-cook batter or dough already present in the cup with optional topping for even greater preparation convenience.

In another aspect, the present articles are smaller in portion size. Current consumer food trends favor items that are portion controlled to provide about 100 calories per finished item.

However, providing shelf stable packaged food batter items of such controlled portion sizes presents unexpected technical challenges. The combination of a MW absorptive food charge such as a dessert batter combined with small portions presents a difficult product tolerance challenge by microwave heating preparation. The difference between insufficient microwave heating (with undesirable unset batter) and excessive (resulting in a dry or even burnt finished product) can be quite small, e.g. 5-10 seconds. Variations in the power output of various consumer microwave ovens, whether the particular unit is equipped with a carousel, and even placement within the microwave heating cavity can exacerbate the problem of providing sufficient product preparation tolerance. As a result, it is believed that no consumer packaged food product is both small in quantity (to provide 100 calories or less) and intended for microwave cooking preparation.

Moreover, the art for packaged food products of greater consumer convenience teaches that products should be designed for ever faster preparation such as by microwave heating. Counter intuitively, the present articles provide greater convenience by purposefully slowing down the time of preparation by impeding microwave absorption to provide for greater preparation tolerance because the food portions are so small.

Surprisingly, the above problems can be overcome and packaged shelf stable batter products for microwave preparation of enhanced heating preparation tolerance can be provided. The present invention provides for cup containers, including a microwave shield, of particular reflectivity that surprisingly provide the needed microwave heating duration tolerance to provide superior finished prepared. Shields can be positioned peripherally around or horizontally above and or below the product. The shield, however, must not so fully enclose the product that no MW energy can reach the product. Some provision must be made to allow MW energy to reach the product.

BRIEF SUMMARY OF THE INVENTION

In its packaging aspect, the present invention resides in packages comprising

- a cup having
- a sidewall body having an inner an outer major surface;
- a bottom attached or extending from the sidewall defining a cup upper open end and an interior cavity
- a sealing surface proximate the open end
- wherein the cup is fabricated from temperature resistant material
- a sealing membrane covering the upper cup open end peelably removably sealed to the sealing surface forming an hermetic seal and wherein the membrane is fabricated from a low oxygen and carbon dioxide permeability sealing membrane material defining a headspace; and,
- a modified low oxygen atmosphere in the headspace, and
- wherein the container has interior cavity having a volume ranging from about 50 to 250 cc., and,
- wherein the cup has a oxygen gas permeability of about 0:1 cc/package/24 hr.

a microwave shield surrounding at least a portion of the sidewall top or bottom sufficient to reflect sufficient incident microwave wave to attenuate the microwave transmission at that area to less than 50%.

In its article aspect, the present invention resides in packaged food products for extended shelf life at room temperatures that comprise about 20-50 g of an uncooked, pre-mixed or ready-to-cook farinaceous batter or dough disposed within package of the present invention.

BRIEF DESCRIPTION OF THE DRAWINGS

FIG. 1 is a cross sectional view, greatly enlarged, of a packaged food article of the present invention.

DETAILED DESCRIPTION OF THE INVENTION

The present invention provides microwave dessert packaged food product articles for individual servings. The articles generally comprise a novel, shielded packaging or container including a microwave shielded cup; a shelf-stable ready-to-cook batter or dough disposed within the cup, a modified low oxygen atmosphere in the headspace above the batter or dough, and a removable, low gas permeability sealing element (e.g., membrane). Each of these components as well as product properties, article preparation and use are described in detail below.

Throughout the specification and claims, percentages are by weight and temperatures in degrees Centigrade unless otherwise indicated. Each of the referenced patents or patent applications is incorporated herein by reference.

Referring now to the drawing, there is depicted a packaged food product article 10 of the present invention comprising a container 12 including a cup 13 having an open top end 14 and defining a cavity 15, and a batter or dough 16 disposed within the cup cavity 15 defining a headspace 18, a modified low oxygen atmosphere 20 in the headspace 18, and a peelably removable, low gas permeability sealing membrane 22 sealing the open end 14.

As can be seen, the cup 13 includes a tapered circular sidewall body 24 having a first or upper larger radius 26 and a second lower smaller radius 28 to define a tapered circular sidewall. Sidewall 24 can include an upper nesting collar 30. Collar 30 allows for convenience in nesting and de-nesting one cup from multiple nested cup units during commercial high speed filling and article fabrication. As can be seen, the nesting collar 30 is formed by a sidewall portion having a third even larger radius 32. Cup 13 additionally includes a sealing flange 34 peripherally extending around the open end and above the nesting collar 30. Cup 13 additionally includes a floor or bottom end 36 opposite the open end 14. Bottom end 36 can include a foot flange 38 for elevating the cup floor 36 when the cup is placed in a microwave oven chamber above the floor of the chamber. One skilled in the art recognizes that the cup can also be of a straightwall cylindrical configuration. The sidewall shape whether tapered or cylindrical can also possess a more complex surface profile for aesthetics, handling, or other functional reasons (e.g., labeling). In still other variations, the circular sidewall can be replaced by a polygonal equivalent (e.g., pentagon, hexagon, oval or even octagon).

In preferred form, the cup cavity can have a total volume ranging from about 50 to 250 mL. Such a volume can be provided by a cup 13 having an average radius ranging from about 27 mm to 53 mm. Such cups include a vertical height 40 ranging from about 35 to about 75 mm extending from the interior surface of bottom end 36 to the interior bottom surface of seal membrane 22.

The cup 13 can be fabricated from a temperature tolerant material, i.e. maintains its strength and shape integrity even at temperatures reached during microwave heating of the product even up to 125° C., such as plastic, whether thermoplastic or thermoset, metal such as aluminum or even temperature resistant paperboard. The material from which the cup is fabricated is preferably microwave transparent or inherently incorporates shielding materials in areas described herein that provide desired shielding effects. One thermoplastic preferred for use herein, the cup is fabricated from polypropylene (including about 1-5% ethyl vinyl alcohol for increase barrier properties). Such cups can be fabricated, when comprised of a thermoplastic material, by blow molding, thermoforming or injection molding in known manner. In one variation, cup 13 including floor 36 are of a single piece construction. In other variations, sidewall 24 and floor or base 36 are formed separately and joined together such as by common techniques as spin welding or sonic welding. Or the floor can be a lidding stock heat sealed to the sidewall or a cap threaded or snap fit lid attached to the sidewall.

In a preferred variation, foot flange or ring 38 elevates the inner surface of bottom 36 about 1 to 15 mm above the microwave cavity for improved microwave heating performance in terms of insuring that the lower portion of the finished heated good is sufficiently cooked.

Importantly, cup 13 includes a microwave reflective shield 50 to attenuate the microwave power reaching the product 16. In preferred form, shield 50 is in the form of a label or sleeve surrounding sidewall 24. The shield can be of any composition or configuration provided that the microwave reflection of the reflective material comprising the shield ranges from about 50-100%. In a preferred form, the shield 50 is in the form of a sleeve or label secured to the outer surface of the sidewall 24. A label can be secured to the sidewall by conventional adhesives. A sleeve can be removably secured by a friction fit or more permanently secured such as by adhesives. The shield 50 can be provided by continuous or discontinuous conductive metallic sheets. Examples include sheets of conductive metals such as aluminum foil, demetallized foils including holes in conductive metallic sheets and islands of conductive metallic elements. Typically the shield is laminated to paper, board or plastics. In other variations (not shown), seal membrane 22 can include microwave reflective shielding as well for additional supplemental microwave power attenuation.

It can be seen that in a preferred form, the shield 50 extends vertically up sidewall 24 to at least the initial height 58 of the uncooked batter. In a preferred form, the shield 50 extends vertically up sidewall 24 to within approximately 10 mm 51 above or below the height 56 achieved by the batter or dough as it expands during microwave heating and cooking to form the finished good. More preferably, the shield 50 extends beyond approximately 10 mm above such expanded volume height 56.

In a preferred form, the shield 50 extends vertically down sidewall 24 to at least 10 mm above the bottom of the batter 16. More preferably, the shield 50 extends vertically down sidewall 24 to at least the bottom of the batter. Most preferably, the shield extends 10 mm beyond the bottom of the batter.

The skilled artisan will appreciate that a material can transmit, absorb or reflect microwave energy. Useful herein as shield materials are those packaging constructions that reflect high percentages (50% or greater) of incident microwave radiation rather than absorb (or transmit). Also, such shields are to be distinguished from microwave susceptor materials that are purposefully constructed to absorb (rather than reflect) incident microwave radiation. Microwave susceptor materials are undesirable in part since the reflection achieved by the susceptor is limited and decreases as the susceptor reaches its temperature limits during heating by microwave energy.

In the preferred embodiment, batter 16 is provided by a shelf stable uncooked farinaceous pre-mixed or "ready-to-cook" batter preferably chemically leavened, useful in the preparation of finished baked good such as a muffin, cake (e.g., a pound cake or a layer cake), brownie, quick bread (e.g., corn bread or banana bread), or cookie.

"Shelf stable" refers to the compositions of the invention being suitable for storage at ambient temperatures (such as room temperature) without the food composition substantially breaking down by, for example, microbial contamination, syneresis or weeping, water accumulation, and the like, and becoming unsuitable for consumption for at least six months. By shelf stable is meant that the product 16 should have at least a six months shelf life. Shelf life includes not only biological stability but also functional operability to provide an expanded finished cooked dessert good. Good results are obtained when the batter has a water activity ($A_w$) value of 0.85 or less at time of fabrication, preferably 0.65-0.85, most preferably about 0.80-0.85. Such low water activity values can be obtained by controlling the amount of water and adding sufficient amounts of low molecular weight ingredients (e.g., salt and/or humectants such as glycerol) to control water activity. In a preferred formulation, the batter 16 includes about 1-6%, preferably about 2-5% glycerol.

By "uncooked" herein is meant a starch and/or flour material that is substantially un-gelatinized (i.e., no more than 8% gelatinization on average). The present batter compositions are thus to be distinguished from already baked or ready-to-eat products that can be merely reheated in a microwave oven.

The batters herein are farinaceous, i.e., starch based batters that include flour and/or starch as the principle structuring ingredient in the finished good. In certain variations, a portion of the starch is provided by pre-gelatinized starch or modified starches that, supplement the principle un-gelatinized or uncooked flour ingredients of the batters herein.

The term "batter" is used herein in a broad sense to refer to not only flowable starch based liquid or fluid mix compositions but also to include non-flowable farinaceous pre-mixed composition embodiments such as cookie doughs.

By "pre-mixed" or, equivalently, "ready-to-cook", is meant that no additional ingredients or stirring in needed. Pre-mixed batters are to be distinguished from dry mixes that require addition of liquids and mixing by the consumer to prepare a batter for cooking.

In other variations, the food charge can additionally include a second differently formulated batter shelf stable layer 42 or, more preferably, a second shelf stable layer in the form of a food topping layer. It will also be appreciated that the batter 16 can be of more than one layer, e.g., a first chocolate portion in the form of a first layer or section and then a second yellow cake portion in the form of a second layer or section. The portions can be different formulations or essentially equivalent (except for minor variations for color or flavor)

In certain preferred variations such as for cakes or muffins, the batter 16 can be chemically leavened. In other variations such as for brownies, the batter can be unleavened or only slightly leavened. In one variation, the leavening can be supplied by a baking leavening system including one or more leavening acid and a source of carbon dioxide, typically sodium bicarbonate. Either the leavening acid(s) or soda or both can be treated (e.g., encapsulated) to prevent premature reaction or loss during the desired extended storage of the present articles. Such encapsulation can include being encapsulated in a fat or other matrix (e.g., sugar or starch). In other variations, all or a portion of the baking leavening system can be substituted by a dissolved soluble gas such as nitrous oxide (MO). In one preferred variation, at least a portion of the leavening acid is supplied by a slow acting leavening acid, and more preferably all, such as sodium aluminum phosphate.

Additionally, in preferred form, those batter ingredients such as salt and water are controlled to provide a batter having suitable dielectric properties (i.e., where $e^*=e'-i\ e''$, and, $\in$ is the complex permitivity $\in'$ is the permitivity (real part of the complex permittivity)

$\in''$ is the dielectric loss factor (imaginary part of the complex permittivity)

i=square root of (—1)

The dielectric properties of the batter can be characterized by the complex permittivity at the microwave frequency of 2450 MHz, as measured using an Agilent 85070D Dielectric Probe Kit and an Agilent 8720ES Network Analyzer. When measured at 25 degrees C., the batter preferably has a relative permittivity (the real part of the complex permittivity) between 4-40. More preferably, the relative permittivity of the batter is between 6-20 and most preferably the relative permittivity of the batter is between 8-14.

When measured at 25° C., the batter preferably has a relative dielectric loss factor (the imaginary part of the complex permittivity) 20 or less. More preferably, the relative dielectric loss factor of the batter is 12 or less and most preferably the relative dielectric loss factor of the batter is less than 0.5-8.

Microbial stability can also be a challenge in a shelf stable product. One common solution to controlling microbial growth is through pasteurization. However, the present invention lends to low microbial load at the time of packaging and formulation to gain the desired shelf life. The batter formulation can contain an anti-mycotic agent which can include sorbic acid and its derivatives such as sodium or potassium sorbate, propionic acid and its derivatives, vinegar, sodium diacetate, monocalcium phosphate, lactic acid, citric acid and so on. These agents are present in an amount to aid in the inhibition of growth of undesirable yeast and/or molds, typically about 0.01 to 1.0% of dry weight basis ingredient such as sodium propionate, potassium sorbate, calcium propionate, sorbic acid and mixtures thereof. The anti-mycotic ingredient can be present in a range of about 0.01% to about 1.0% on a dry weight basis Useful herein, are those batter compositions described in, for example, US 200410043123 "Refrigerable Extended Shelf-Life Liquid Batter And Method For Its Production" (Published Mar. 4, 2004 by Angeliki Triantafyllou Oste, et al.). While such batters are intended to be distributed under refrigerated conditions, it has been found that such compositions can also be used in the present shelf-stable product executions when controlled for microbial growth and when the present modified packaging atmosphere is also employed.

In another variation, the batters can be provided by those formulations described in commonly assigned co-pending PCT Application US 2006/18423 filed May 10, 2006 "Batter compositions and Methods of Preparing and Using Same".

| Ingredient | Amount (weight percent) |
|---|---|
| Sweetening agent | 5-55 |
| Flour or Flour replacement | 12-25 |
| Fat component | 0-25, preferably 1-10 |
| Leavening system | 0-5, preferably) .5-3% |
| Minors (e.g. flavors, cocoa, salt, protein, starch) | 0-6, preferably 0.5-4% |
| Water | 5-40 |
| Total | 100% |

Broadly, the batter 16 can comprise:

Prior to microwave heating and during initial storage, batter 16 occupies a portion of the total batter volume or $V_B$ designated by reference numeral 52 and extends to a initial batter height 58 about 15 mm above floor 36.

The batter 16 is sealed within the container 12 by sealing membrane 22. Sealing membrane 22 is peelably secured to flange 34 such as with a cold or pressure adhesive to provide a hermetic (i.e., without a venting hole) seal to package 12. In preferred form, membrane 22 is provided from a packaging film selected for both low oxygen and low carbon dioxide permeability. In one embodiment, the membrane 22 is fabricated from packaging film that is a single layer formed of a film or a single sheet. In another embodiment, the membrane is fabricated from other packaging film such as a laminate, a co-extrusion, coated or a combination thereof. Preferably, the membrane material is selected to be of low oxygen permeability. Typical low oxygen permeable packaging materials have an oxygen permeability about 0.1 cc/100 $in^2$/24 hr (<1.55 cc/$m^2$/24 hr.) or less. In a further embodiment, sealing membrane is provided by a flexible packaging film laminate having an oxygen permeability of no greater than about 0.08 cc/100 $in^2$/24 hr (<1.24 cc/$m^2$/24 hr.). The laminate can be a flexible material comprising a polymer substrate selected from the group consisting of polyethylene (PE), polypropylene (PP), polyethylene terephthalate (PET), and polylactic acid (PLA), an oxygen barrier layer, and a moisture barrier layer. The laminate can further comprise a film or ceramic including a component selected from the group consisting of oxygen scavengers and antioxidants. In one embodiment, oxygen scavengers are incorporated into the substrate, the oxygen scavengers being selected from the group consisting of light activated oxygen scavengers and conventional oxygen scavengers. In one embodiment, the laminate is a flexible material comprising a layer of polyester aluminum oxide coated polyester, and a peelable polypropylene sealant layer. In a further embodiment, the laminate comprises a moisture barrier coating exterior of an oxygen barrier coating.

Optionally, container 12 can include a lid (not shown), e.g., a flexible or rigid plastic member, overlaying sealing membrane 22 that engages the flange 34 such as with a friction fit to provide additional packaging protection, e.g., resealability.

The container 12 additionally includes a headspace above the batter 16, or, if a topping layer above the batter such as a frosting layer 42 is present, then above the topping layer. Prior to microwave heating (e.g., upon initial fabrication), the head space will have a partial volume or portion of the total volume $V_H$ designated by reference numeral 54. The headspace can be filled with a modified low oxygen atmosphere 20. In a preferred variation, the headspace package atmosphere has an oxygen content of 2% or less, preferably about 1% or less, and for best results, 0.5% $O_2$ or less. Provision of a low oxygen headspace atmosphere is helpful in providing extended microbial stability to assist in providing the desirable extended shelf like at room temperature storage.

Providing an internal partial vacuum (0.5-0.9 atm) low oxygen atmosphere 20 or a reduced headspace volume 18, such an indented sealing member, allows for expansion of the headspace gas 20 due to changes in altitude that can be experienced during shipping such as across mountain ranges to minimize the likelihood of rupturing the integrity of the seal closure of membrane 36.

While specific materials of construction can be used for the cup body 23 and for the sealing membrane 36, the overall construction of the sealed container 12 should be controlled to provide low oxygen and $CO_2$ gas permeability. Generally, the container 12 as a whole is characterized by having an oxygen gas permeability no greater than about 0.1 cc $O_2$/package/24 hr, preferably 0.01 cc $O_2$/package/24 hr. or less.

Now that the basic construction of article 10 including batter 16 according to the preferred teachings of the present invention has been explained, preferred modes of use of article 10 according to the teachings of the present invention can be set forth.

The present articles are adapted to be used or heated by common consumer microwave ovens (typically ranging in power from about 500-1500 watts, based on commercially available improvements to wattage options as manufacturing optimization has evolved, and operating at 2450 MHz) for a specified time. Such variety in wattage options and availability creates difficulty in specifying cooking time for optimal raw batter cooking results. Microwave ovens commonly include one or more 'express cook' buttons that operate the microwave for specific time durations. Typically, such buttons will operate the microwave at full power for 30 seconds or one minute. When an item to be microwaved is small in size, microwave cooking without the use of a microwave shield will typically be much shorter than 30 seconds due to the microwave load, and upon microwaving to a time period such as 30 seconds, the products will have been overcooked and/or scorched in some localized areas. Small products inherently absorb microwaves in an overexaggeratedly irregular fashion, especially at short microwave cooking times of under 30 seconds, thus creating a large disparity of temperature depending on location within a particular product. The use of the 30 second or one minute button will provide more energy than the product can disperse in an even fashion. Without shielding, extreme hot spots, as well as cool, uncooked spots, will result and the product will prematurely 'set' in structure before a more optimal and even baked volume can be achieved. Surprisingly, by shielding the uncooked batter, the microwave time can be significantly prolonged, with a minimized disparity of temperature throughout the product. Providing a package and product with a much improved ability to tolerate overheating (excess microwaving) allows for a greatly improved consumer experience.

It is an advantage of the present articles that notwithstanding the range of power of various consumer microwave ovens or whether they are equipped with a carousel that the present articles exhibit sufficient preparation abuse tolerance such as to nonetheless provide consistently a high quality finished good even after extended room temperature storage. Also, even when the consumer inaccurately microwave cooks the article for a time different than specified in the preparation instructions sufficient tolerance is exhibited to provide a high quality finished good. Moreover, during microwave cooking preparation, the products regrettably offer poor visual clues to doneness or over doneness and so the consumer must rely primarily upon written instructions for preparation time selection (Many consumers are inattentive to such instructions, whether due to distraction or language familiarity, or are too young to follow such instructions). Also, due to the small size of the present articles, inclusion of sufficient specific preparation instruction may not be possible due to lack of adequate surface area to present such instructions clearly. Often, a large portion of the external surface area (sidewall or sealing membrane) is filled with information required by food regulation or even basic product name identification.

As the microwave article is microwave heated, the batter 16 warms sufficiently to activate the leavening acid which upon reacting with the leavening soda releases leavening gas to expand the batter. When the batter reaches the cooking temperature sufficient to gelatinize the starch component of the flour, the batter begins to set forming an expanded finished good structure. The cooking is desirably complete when the batter completes its batter to cake structure conversion (typically when internal temperatures are reached of approximately 100° C. and top surface temperatures ranging from about 105-115° C.). It is a further advantage of the present articles that the construction provides even heating and thus cooking of the batter 16. Such even heating provides for a desirable homogeneous texture in the finished good rather than regions of uncooked batter interspersed with overcooked regions.

Counter intuitively, another advantage of the present articles is increasing the amount of time to heat and cook the product. Allowing more time for temperature equilibration across the product reduces the likelihood of local hot spots developing and facilitates stopping the cooking at near the optimum preparation time.

To allow sufficient volume for expansion during microwave heating the ratio of VH to VB should be at least 1, i.e., VH/VB≥1 preferably 2-6, more preferably 3 or greater, e.g., 3-5.

Typically, in an optimal finished good, the moisture content ranges from about 95%-97% of the initial moisture content while moisture loss upon cooking of 10% or greater is indicative of over cooking.

In a preferred preparation technique, the sealing membrane 36 is partially but only partially removed or broken to allow for gas escape during microwave cooking. In a preferred execution, sealing membrane 36 additionally includes a tab (not shown) to facilitate such partial removal. However, it is a further advantage of the present article that sufficient preparation tolerance is provided such that even if the sealing membrane 36 is completely removed, that sufficient sidewall microwave shielding is present to allow for successful preparation of a finished good that moisture loss is not excessive (i.e., less than 90% of initial moisture content when heated for the specific instructed time durations). Also, the shield 50 is helpful in providing both a more uniform visual appearance and also a softer texture or eating quality in the finished baked good.

Moreover, shielding 50 can be constructed to provide not only microwave reflection but additionally temperature insulation against burning the consumer even though the article is immediately used for consumption after microwave heating.

In another variation, the interior surface of cup 13 can include an anti-stick coating to facilitate removal of the finished good after microwave heating cooking.

In one variation, one or more articles 12 can be adjoined (not shown), e.g., six, to form a multi-pack product. Such multi-packs can be formed, for example by adjoining individual articles at their sealing flanges such as by including a breakable intermediate tab. In other minor variations, the tabs are co-extensive but include a fracture line or crease or score line to facilitate disengaging a single article from the multi-pack. In still other variations, two or more, e.g., four, articles can be co-packed to form a multi-pack by including an overwrap and/or a sleeve to secure the items together.

In microwave cooking of small products, moisture loss is rapid resulting in numerous large holes in the baked product surface. However, if shielding is present, the moisture loss is slower leaving a smoother and more consistent product surface after microwaving. This improvement makes the product appear more like a traditional baked product rather than a uneven microwave product. Additionally, since the moisture loss is at a slower rate with a shielded product, slight over microwaving does not have a effect on the texture of the finished product.

Still another advantage of the present articles is the minimization of the problem of runaway heating and the generation of local hotspots leading to undesirable burnt and raw regions in the finished baked good. Microwave heating can produce runaway heating, that is, when a small portion becomes heated, its dielectric loss factor can increase leading towards a tendency for greater microwave absorption. The extremely small batter quantities of the present articles can exacerbate the tendency for runaway heating. Thus, it is an advantage of the present invention that the finished articles are characterized by a greater uniformity in heating and cooking notwithstanding their diminutive size leading to desirable greater homogeneity in the finished baked good prepared herein.

Another advantage of the present articles is increasing the amount of time to heat and cook the product. Counter-intuitively, allowing more time for temperature to equilibrate across the product creates less chance of local hot spots and the ability to more easily end the cooking at near the optimum preparation time.

Still another advantage of the present articles resides in the provision of greater preparation abuse tolerance. Insufficient heating can result in unheated unbaked regions while excessive heating can result in burnt regions. Absent the present microwave shielding, the preparation tolerance window between underdone and overdone might be as little as a few seconds. In contrast, the preparation tolerance window provided herein can be up to thirty seconds. The present product provide almost an order of magnitude improvement in the cooking time tolerance (from only 3-5 seconds tolerance without a shield to 30-40 seconds with a shield).

In still other variations, the shelf stable batter 16 can be substituted with equivalent amounts of batters intended for either refrigerated or frozen distribution and storage.

In still other variations, all or a portion of the required total microwave reflection can be provided by provided by container 12 with shielding on either the membrane 22 and/or as part of bottom 36. In one variation, bottom 36 is provided with a microwave shield (not shown) such as a label secured to the exterior bottom surface of the cup 13. In another variation, the sealing membrane can be fabricated with a shield layer to provide supplemental microwave shielding. Regardless of particular construction, it is preferred herein that the reflective components be characterized by a total microwave reflection value of at least 50%.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A packaged article for the microwave cooking preparation of a finished baked good exhibiting significant preparation abuse tolerance of overcooking, comprising:

a cup having:

a sidewall body having an inner and an outer major surface;

a bottom attached or extending from the sidewall defining an upper cup open end and an interior cavity, with the interior cavity having a volume ranging from about 50 to 250 cc; and a sealing surface proximate the open end, wherein the cup is fabricated from temperature resistant material and has a oxygen gas permeability of about 0.1 cc/package/24 hr. or less, an uncooked farinaceous shelf-stable ready-to-cook batter or dough disposed within the interior cavity of the cup, a sealing membrane covering the upper cup open end defining a headspace having a modified low oxygen atmosphere, said membrane being peelably removably sealed to the sealing surface forming an hermetic seal and wherein the membrane is fabricated from a low oxygen and carbon dioxide permeability sealing membrane material, and, a microwave shield surrounding at least a portion of the sidewall body containing the uncooked shelf-stable ready-to-cook batter or dough configured to reflect sufficient incident microwaves to attenuate microwave transmission at that area to less than 50%.

2. The packaged article of claim 1 wherein the shield is in the form of a sleeve.

3. The packaged article of claim 2 wherein the sleeve has a laminated construction having at least one support layer and at least one microwave reflection layer.

4. The packaged article of claim 1 wherein the uncooked farinaceous shelf-stable ready-to-cook batter or dough constitutes an uncooked farinaceous ready-to-cook batter disposed within the cup.

5. The packaged article claim 2 wherein the uncooked farinaceous shelf-stable ready-to-cook batter or dough constitutes an uncooked farinaceous ready-to-cook batter disposed within the cup.

6. The packaged article of claim 1 wherein the shield is in the form of a label adhered to the sidewall.

7. The packaged article of claim 4 in the form of a packaged food article, additionally comprising:

about 25-50 g of the uncooked farinaceous ready-to-cook batter for a baked good disposed within the cup.

8. The packaged article of claim 7 wherein the batter has a water activity value ranging from about 0.6-0.85 and additionally comprising a modified packaging atmosphere in the headspace having an oxygen content of 2% or less.

9. The packaged article of claim 7 wherein the uncooked batter is refrigerated.

10. The packaged article of claim 8 wherein the batter is for a layer cake, muffin, quick bread, brownie or cookie.

11. The packaged article of claim 1 wherein the shield is in the form of a sleeve having at least one support layer and at least one microwave reflection layer, and wherein the package has an oxygen permeability of 0.01 cc O2/package/24 hr or less;

wherein the cup is fabricated from a thermo-formed plastic;

wherein the cup includes a foot flange sufficient to elevate the exterior surface of the bottom about 1-5 mm;

wherein the cup additionally includes a nesting collar proximate the cup open end; and, wherein the uncooked shelf-stable ready-to-cook batter or dough constitutes about 25-50 g of an uncooked shelf stable farinaceous ready-to-cook batter comprising sugar, flour, shortening, glycerol, leavening and flavoring for a layer cake disposed within the cup having a water activity ranging from about 0.80 to about 0.85; and, a modified packaging atmosphere in the headspace having an oxygen content of 1% or less.

12. The packaged article of claim 10 adapted to prepare a finished baked good by microwave heating for about 30-90 seconds.

13. The packaged article of claim 10 wherein the modified atmosphere is at an internal partial vacuum.

14. The packaged article of claim 12 wherein the modified atmosphere has an oxygen content of 1% or less.

15. The packaged article of claim 14 wherein the package has an oxygen permeability of 0.01 cc O2/package/24 hr or less.

16. The packaged food article of claim 15 wherein the batter has a water activity ranging from about 0.8-0.85.

17. The packaged food article of claim 16 additionally comprising a topping layer overlaying at least a portion of the batter.

18. The packaged article of claim 15 wherein the cup additionally includes a nesting collar proximate the cup open end.

19. The packaged article of claim 15 wherein the cup is fabricated from a thermo-formed plastic.

20. The packaged food article of claim 15 wherein at least a portion of the microwave shield is provided on the sealing membrane.

21. The packaged article of claim 15 wherein the cup includes a foot flange sufficient to elevate the exterior surface of the bottom about 1-5 mm.

22. The packaged article of claim 15 wherein the batter comprises glycerol.

23. The packaged article of claim 15 wherein the shield is in the form of a label adhesively secured to at least a portion of the outer surface of the sidewall.

24. The packaged article of claim 1 wherein at least a portion of the sidewall is circular.

25. The packaged article of claim 4 wherein the batter is for a layer cake and has an initial moisture content.

26. The packaged article of claim 12 wherein the finished baked good has a density of less than 0.25-0.6 g/cc and a finished moisture content of at least 95% of its initial moisture content.

27. The packaged food article of claim 10 wherein the batter has a relative dielectric loss factor 20 or less.

28. The packaged article of claim 10 wherein the batter has an initial volume and wherein the ratio of headspace volume to batter initial volume is at least 2:1.

* * * * *